United States Patent [19]

Raether, deceased

[11] 4,166,015

[45] Aug. 28, 1979

[54] PROCESS FOR THE MANUFACTURE OF ALUMINUM SUPPORTS FOR PLANOGRAPHIC PRINTING PLATES BY ELECTROCHEMICAL ROUGHENING OF THE PLATE SURFACES

[75] Inventor: Siegfried Raether, deceased, late of Idstein, Fed. Rep. of Germany, by Edith Raether, heir

[73] Assignee: Hoechst Aktiengesellschaft, Fed. Rep. of Germany

[21] Appl. No.: 815,378

[22] Filed: Jul. 13, 1977

Related U.S. Application Data

[63] Continuation of Ser. No. 716,646, Aug. 23, 1976, abandoned.

[30] Foreign Application Priority Data

Aug. 25, 1975 [DE] Fed. Rep. of Germany ..... 2537725

[51] Int. Cl.[2] ..... C25F 3/04

[52] U.S. Cl. ..... 204/129.75; 204/129.8

[58] Field of Search ..... 204/129.75, 129.8, 129.85

[56] References Cited

U.S. PATENT DOCUMENTS

| | | | |
|---|---|---|---|
| 2,598,043 | 5/1952 | Eichner | 204/129.75 |
| 2,853,445 | 9/1958 | Catotti et al. | 204/129.75 |
| 3,284,326 | 11/1966 | Martin | 204/129.75 |
| 3,316,164 | 4/1967 | Welch, Jr. | 204/129.75 |

*Primary Examiner*—T. M. Tufariello

*Attorney, Agent, or Firm*—James E. Bryan

[57] ABSTRACT

This invention relates to an improvement in the process for the manufacture of aluminum supports for planographic printing plates by electrochemical roughening of the surfaces in agitated aqueous electrolyte solutions, the improvement comprising that the electrolyte used is an aqueous solution of an aluminum salt.

5 Claims, No Drawings

PROCESS FOR THE MANUFACTURE OF ALUMINUM SUPPORTS FOR PLANOGRAPHIC PRINTING PLATES BY ELECTROCHEMICAL ROUGHENING OF THE PLATE SURFACES

This is a division of application Ser. No. 716,646, filed Aug. 23, 1976, now abandoned.

The present invention relates to a process for the electrochemical roughening of the surfaces of aluminum plates which are to be used as supporting materials for planographic printing plates.

The use of aluminum supports for planographic printing plates generally has been accepted and proved to be advantageous.

It is known to subject the surfaces of aluminum supports for planographic printing plates to a pretreatment in order to improve the adhesion of the image-carrying layer and the hydrophilic properties of the aluminum support.

Thus, mechanical treatments have been proposed, for example brushing with wire brushes or wet-brushing with abrasives. Recently, electrochemical roughening, followed, if desired, by anodic oxidation, has increasingly gained importance. Preferably, the roughening process is continuously operated, i.e. the materials to be roughened are in the form of webs.

Satisfactory qualities are achieved by mechanical roughening processes. Among the known processes, wire brushing yields a directionally oriented surface which still has a silvery luster. Brushing with the aid of graining abrasives and water produces a dull gray surface which in only exceptional cases shows a directional orientation. By far the most favorable results are produced by electrochemical roughening in acid baths. The uniformity of the roughening thus produced is achieved by no other known method.

As a rule, acid-containing electrolytes are used for roughening. The rinsing solutions and spent baths resulting from this treatment must be decontaminated at considerable expense. Handling, storage, and equipment must be adapted to the corrosive media, which also causes large costs.

Further, it has been proposed to manufacture foils for electrolytic condensers by subjecting aluminum surfaces to an electrochemical treatment with neutral or only slightly corrosive solutions. Being intended for a different purpose, these foils require surfaces which are quite different from those of planographic printing plates, however.

In a process for the manufacture of a condenser foil disclosed in German Auslegeschrift No. 1,262,721, for example, sodium chloride is used together with sodium bisulfate in an anodic circuit arrangement at a low pH value and high temperatures, the desired pH range being adjusted by the continuous addition of sulfuric acid. In this Auslegeschrift, reference is made to another prior art process in which an aqueous aluminum chloride solution is used as the electrolyte and the aluminum is subjected to an anodic treatment.

It is the object of all these prior art processes to modify the aluminum in a manner such that pores of maximum depth are formed by which a maximum increase of the aluminum surface is produced. A surface treated in this manner is not very suitable, however, for use as a support for planographic printing plates. Too deep, and often irregularly distributed, depressions impede processing at all stages.

Normally, a very uniform, directionally unoriented roughening of medium depth is desired for planographic printing plate supports. Above all, it should guarantee a good adhesion of the light-sensitive layer to be applied thereto and good hydrophilic properties during the printing process.

On the other hand, however, it is desirable in the manufacture of planographic printing plate supports to have available, in addition to types of surfaces which may be used for many purposes, also such surfaces which are adapted to special purposes and which differ from each other in a characteristic manner, for example by the depth of roughening, the number and size of their pores, the distribution of the pore sizes, and other parameters. The demand for such different types of surfaces is determined by the nature of the light-sensitive layer, the run to be printed, the printing technique to be employed, etc. So far it was known only that for producing surfaces of different types, electrolyte solutions of different compositions had to be selected. This means that time-consuming changeover operations were invariably necessary if it was desired to successively produce, in one and the same plant, aluminum webs with different types of roughening.

It is the object of the present invention to provide a process for the electrochemical roughening of aluminum surfaces which may be operated with as little environmental pollution as possible and which renders it possible to produce surfaces with different types of roughening by changing easily variable process parameters.

The present invention provides a process for the manufacture of aluminum supports for planographic printing plates by electrochemical roughening of aluminum surfaces in agitated aqueous electrolyte solutions, the electrolyte used being an aqueous solution of an aluminum salt.

The inventive process has the advantage that only very little of the electrolyte used is consumed. Consequently, it has the further advantage that only small quantities of spent electrolyte solution result to be disposed of, without damage to the environment. The aluminum dissolved during the electrochemical roughening process precipitates in the form of aluminum hydroxide or aluminum oxide hydrate and thus may be continuously removed from the mixture by filtration or centrifuging.

Prior to electrochemical roughening, the aluminum is normally pickled in the conventional manner with an aqueous-alkaline solution in order to clean and degrease the surface thereof.

The usability of the electrolyte solutions employed according to the present invention is practically unlimited. Other than in the case of acid-containing electrolytes, only those components must be replaced which are lost by entrainment. This means a considerable rationalization in the storage and handling of the chemicals used.

Depending upon the anion and further additives which may be used, the pH of the electrolyte is between about 1 and 5. It remains practically unchanged during operation of the process.

Aluminum chloride or aluminum nitrate are preferably used as electrolytes. The salts are normally used in concentrations of from about 50 g, preferably from 200 g per liter, to the saturation point.

Good results also may be obtained when using other halides or salts of oxygen-containing halogen acids, especially the bromides and chlorates, but also the nitrites. In addition to the aluminum salts, the electrolytes also may contain alkali or ammonium salts of the same anions.

Different degrees and types of roughening may be produced by selecting an appropriate type of current and circuit arrangement. Either direct current or alternating current may be applied, and in the case of direct current the aluminum may be connected in the circuit either as the anode or the cathode. If electrolytes are used which contain only aluminum salts, no roughening occurs with direct current and a cathodic circuit arrangement, but may be caused by adding alkali salts to the electrolytes.

In the case of the two other circuit arrangements, in which the anion is responsible for the roughening action, either pure aluminum salt electrolytes or mixed electrolytes containing aluminum salts and alkali salts may be used.

If a direct current is applied and the circuit arrangement is cathodic, the aluminum plate is first degreased by means of an alkaline pickling solution and then treated for about 30 to 60 seconds with a current density between 2,000 and 9000 C/dm$^2$, which corresponds to about 70–150 A/dm$^2$. A silvery surface with a dull finish is produced which very much resembles that of a directionally unoriented, wire-brushed surface (Type A). The depth of roughening of the material thus obtained ranges from about 9 to 12 $\mu$m. The good contrast between the support and the light-sensitive layer applied thereto allows an effective visual control during processing of the resulting printing plates. When the process described for Type A is applied, using, however, direct current in an anodic circuit arrangement, a dull gray, visually uniform surface is produced which resembles known surfaces produced by electrochemical treatment with acid-containing electrolytes (Type B). The depth of roughening of surfaces of this type may range from about 7 to about 20 $\mu$m, depending on the electrolyte selected, the current density, and the like.

If alternating current is applied, a more pitted surface results which does not appear as uniform to the eye but is nevertheless very suitable for the manufacture of an offset printing plate (Type C). In this case, the depth of roughening ranges from about 15 to 20 $\mu$m. (In all cases, the depth of roughening was measured by means of a "Perthometer", type S 10 D.)

If a surface of Type A is to be produced, it is necessary to add alkali cations, especially Na or K cations, in concentrations ranging from about 30 g per liter to the point of saturation.

With an anodic arrangement or alternating current, ammonium salts may be used to increase the concentration of the desired anion after the saturation limit of the aluminum salt has been reached.

Urea, for example in the form of the chloride or nitrate, was found to be suitable as the anion carrier. The inhibiting action of this compound, which is known from conventional corrosion tests, is not so effective in the electrochemical treatment of aluminum as to prevent roughening.

The inventive process may be applied to single sheets, in a simple trough equipped with the necessary circulating and current supply devices, or to webs in appropriately designed, continuously operating plants. The current transfer in these plants may be either by contact rollers or by the neutral-wire method.

Suitable apparatuses for performing the process of the invention are described, for example, in German Offenlegungsschriften No. 2,234,424, and No. 2,228,424.

Of course, these apparatuses must be provided with temperature control and adjusting devices. The working range of the process of the present invention extends normally from room temperature (20° C.) to the boiling point of the solutions used. The application of lower temperatures, even those approaching the solidifying point of the solutions, is possible but not recommended in view of the high cooling costs.

In the case of a cathodic circuit arrangement, a relatively high reaction temperature within the range stated, i.e. between about 40 and 80° C., preferably between 50° and 60° C., is normally of advantage.

In the case of an anodic arrangement and an alternating current circuit, temperatures between 20° and 35° C. are generally preferred.

In order to facilitate the heat exchange and flow of material at the aluminum surface, the electrolyte is stirred or circulated by pumping. The velocity of flow is advantageously maintained between about 0.1 and 5 m per second, preferably between 0.8 and 1.5 m/sec. These values refer to an operation of the inventive process on a technical scale, especially in a continuous operation and treating continuously fed webs of aluminum. Some of the experiments described were made on a laboratory scale, so that the values stated in the examples may deviate from the optimum values.

If the current densities applied fall substantially below the values stated above and an equivalent quantity of current is achieved by prolonging the reaction time, poorer results are normally achieved.

Likewise, it is not always advisable to increase the current density while simultaneously shortening the reaction time. In most cases, this results in a heavy removal of metal and produces very smooth, almost electro-polished surfaces.

The voltage required depends largely upon the distance between the electrodes. For this reason, this distance should be made as small as possible. In order to guarantee the necessary exchange of material, distances ranging from about 0.5 to 5 cm, preferably from 0.6 to 1.5 cm, are preferred. Wider distances are possible, but require higher voltages. The examples below describe a number of experiments using testing plants in which the distance between electrodes did not correspond to the optimum values stated above.

The surface roughened by the process according to the invention may be either directly provided with a light-sensitive layer or first anodized.

If copying layers based on diazo compounds are used, non-anodized surfaces of Type A yield 10,000 to 30,000 copies of good quality, and non-anodized surfaces of Types B and C yield about 50,000 copies. Subsequently anodized plates yield runs which correspond to a multiple of the above values, the increase being more conspicuous in the case of Types B and C than in the case of surfaces of Type A.

Like the roughening process, anodization may be performed in known manner, treating either individual sheets or endless webs. Suitable apparatuses are described, for example, in German Offenlegungsschriften No. 2,420,704, and No. 1,906,538.

The following examples describe the inventive roughening of aluminum in different electrolyte solutions. In all examples, a web of smooth rolled aluminum with an aluminum content of 99.5 percent was used. Prior to electrochemical roughening, the web was subjected for 30 seconds, at a temperature of 50° to 60° C., to an alkaline pickling treatment in an aqueous solution containing 20 g of NaOH per liter of water. About 3 g of aluminum per square meter were removed by this treatment.

In the following examples, all percentages are by weight unless otherwise stated.

EXAMPLE 1

| Electrolyte: | 200 g of sodium chloride and 300 g of $AlCl_3 . 6H_2O$ per liter of softened water. | | | |
|---|---|---|---|---|
| Circuit Arrangement | Current Density ($A/dm^2$) | Temperature, (°C.) | Time, (secs.) | Appearance |
| Anodic | 70 | 30 | 30 | dull dark gray |
| Cathodic | 100 | 50 | 60 | dull silvery finish |
| Alternating current (50 Hz) | 70 | 30 | 30 | dull dark gray |

| | |
|---|---|
| Distance between electrodes: | 5 cm. |
| Flow velocity of electrolyte: | 0.3–0.4 m/sec. |
| pH value of the solution: | 2 |

If a solution containing 200 g of sodium nitrate and 200 g of $Al(NO_3)_3.9H_2O$ per liter is used, the same alteration of the aluminum surface results. In the case of an anodic circuit arrangement and alternating current, however, the resulting surfaces are of a lighter shade of gray.

EXAMPLE 2

| Electrolyte: | 200 g of $Al(NO_3)_3 . 9H_2O$ per liter of softened water. | | | |
|---|---|---|---|---|
| Circuit Arrangement | Current Density ($A/dm^2$) | Temperature, (°C.) | Time, (secs.) | Appearance |
| Anodic | 100 | 30 | 30 | dull light gray |
| Cathodic | 100 | 60 | 30 | no corrosion, formation of oxide deposit |
| Alternating current (50 Hz) | 100 | 30 | 30 | dull gray |

| | |
|---|---|
| Distance between electrodes: | 5 cm. |
| Flow velocity of electrolyte: | 0.3 m/sec. |
| pH value of solution: | approximately 3 |

It will be obvious to those skilled in the art that many modifications may be made within the scope of the present invention without departing from the spirit thereof, and the invention includes all such modifications.

What is claimed is:

1. In the process for the manufacture of a photosensitive material for the production of planographic plates, wherein the surface of an aluminum support is electrochemically roughened in an agitated aqueous electrolyte solution, and then coated with a photosensitive reproduction layer, the improvement comprising that said aqueous electrolyte solution has a pH value from 1 to 5 and consists essentially of water and from about 200 g per liter to the saturation point of an electrolyte selected from the group consisting of aluminum chloride, aluminum nitrate, and said aluminum salts in combination with alkali or ammonium chlorides or nitrates, and that a current density of about 70 to 150 $A/dm^2$ is used for the electrochemical roughening step.

2. A process according to claim 1 including anodically oxidizing said aluminum support prior to coating with said photosensitive reproduction layer.

3. A process according to claim 1 in which direct current is applied, the aluminum is connected in the circuit as the cathode, and an alkali salt in an amount from 30 g per liter to the point of saturation is added to the electrolyte solution.

4. A process according to claim 1 in which direct current is applied and the aluminum is connected in the circuit as the anode.

5. A process according to claim 1 in which alternating current is applied.

* * * * *